US008141974B2

(12) United States Patent
Noro et al.

(10) Patent No.: US 8,141,974 B2
(45) Date of Patent: Mar. 27, 2012

(54) ROTARY-MEMBER CONTROL APPARATUS

(75) Inventors: Hideo Noro, Kamiina-gun (JP); Toshio Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 528 days.

(21) Appl. No.: 12/357,941

(22) Filed: Jan. 22, 2009

(65) Prior Publication Data

US 2009/0184988 A1 Jul. 23, 2009

(30) Foreign Application Priority Data

Jan. 23, 2008 (JP) ..... 2008-012962
Mar. 4, 2008 (JP) ..... 2008-053812
Dec. 3, 2008 (JP) ..... 2008-308989

(51) Int. Cl.
*B41J 29/38* (2006.01)

(52) U.S. Cl. ..... 347/16

(58) Field of Classification Search ..... 347/16
See application file for complete search history.

(56) References Cited

U.S. PATENT DOCUMENTS 6,049,690 A * 4/2000 Nakayasu et al. ..... 399/301
6,404,507 B1 * 6/2002 Hamamoto et al. ..... 358/1.5
6,507,713 B2 * 1/2003 Koide ..... 399/51

FOREIGN PATENT DOCUMENTS

JP 08-300838 11/1996
JP 10-193582 7/1998
JP 2000-218885 8/2000
JP 2005-033889 2/2005

* cited by examiner

*Primary Examiner* — Uyen Chau N Le
*Assistant Examiner* — Hoang Tran
(74) *Attorney, Agent, or Firm* — Workman Nydegger

(57) ABSTRACT

A rotary-member control apparatus includes a rotary member that rotates while supporting an object on the outer curved surface of the member. A motor is supplied with current based on a current profile representing the magnitude pattern of current to rotate the rotary member. A detecting element detects a rotation state of the rotary member during rotation. A control unit generates a one-rotation current profile, representing the magnitude pattern of current corrected on the basis of the detected rotation state, corresponding to one rotation of the rotary member, and supplies corrected current to rotate the rotary member. When the length of the medium in the rotation direction, the length of the medium in the axial direction, or the type of the medium is changed, the control unit generates the one-rotation current profile before starting printing, and repeatedly supplies the corrected current to the motor to print the image.

2 Claims, 10 Drawing Sheets

ROTARY-MEMBER CONTROL APPARATUS

CROSS-REFERENCE TO RELATED APPLICATIONS

This application claims priority under the Paris Convention based on

Japanese Patent Application No. 2008-12962 (filed on Jan. 23, 2008)

Japanese Patent Application No. 2008-53812 (filed on Mar. 4, 2008) and

Japanese Patent Application No. 2008-308989 (filed on Dec. 3, 2008)

BACKGROUND

1. Technical Field

The present invention relates to a rotary-member control apparatus.

2. Related Art

As a rotary-member control apparatus controlling a rotary member that is rotatable while supporting an object on the outer curved surface of the member, there is known a liquid discharge apparatus (e.g., an ink jet printer) that includes a rotary member and discharges ink, serving as a liquid, onto a medium, serving as an example of the object supported, to print an image.

JP-A-10-193582 discloses such a printer. The printer further includes a discharging unit that discharges ink onto a medium supported on the rotary member. During rotation of the rotary member supporting the medium, the discharging unit discharges ink, so that an image is printed. The printer further has a motor that rotates the rotary member. The motor is supplied with current based on a current profile, representing the magnitude pattern of current, to rotate the rotary member.

Assuming that the rotary member has a structure in which the rotary member rotates while supporting a medium, in some cases, the rotary member becomes eccentric. In particular, when media have various lengths, the degree of eccentricity tends to vary depending on the length. If the rotary member is eccentric, the rotational speed of the rotary member easily fluctuates during rotation, so that rotational variation occurs.

SUMMARY

An advantage of some aspects of the invention is to easily suppress rotational variation of a rotary member supporting an object.

According to an aspect of the invention, a rotary-member control apparatus includes the following elements. A rotary member is rotatable while supporting an object on the outer curved surface of the member. A motor is supplied with current based on a current profile representing the magnitude pattern of current to rotate the rotary member. A detecting element detects a rotation state of the rotary member during rotation. A control unit generates a one-rotation current profile, representing the magnitude pattern of current corrected on the basis of the rotation state detected through the detecting element and corresponding to one rotation of the rotary member, and supplies corrected current based on the generated one-rotation current profile to the motor to rotate the rotary member. The rotary-member control apparatus is a liquid discharge apparatus including a discharging unit that discharges a liquid onto a medium serving as the supported object. While the control unit repeatedly supplies the corrected current based on the generated one-rotation current profile to the motor to rotate the rotary member supporting the medium a plurality of times, the control unit allows the discharging unit to discharge the liquid onto the medium in order to print an image. When at least one of the length of the medium in the rotation direction in which the rotary member rotates, the length of the medium in the axial direction of the rotary member, and the type of the medium is changed, the control unit generates the one-rotation current profile before the start of printing, and repeatedly supplies the corrected current based on the generated one-rotation current profile to the motor to print the image.

Other features of the invention will be apparent from the following detailed description of preferred embodiments of the invention in conjunction with the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
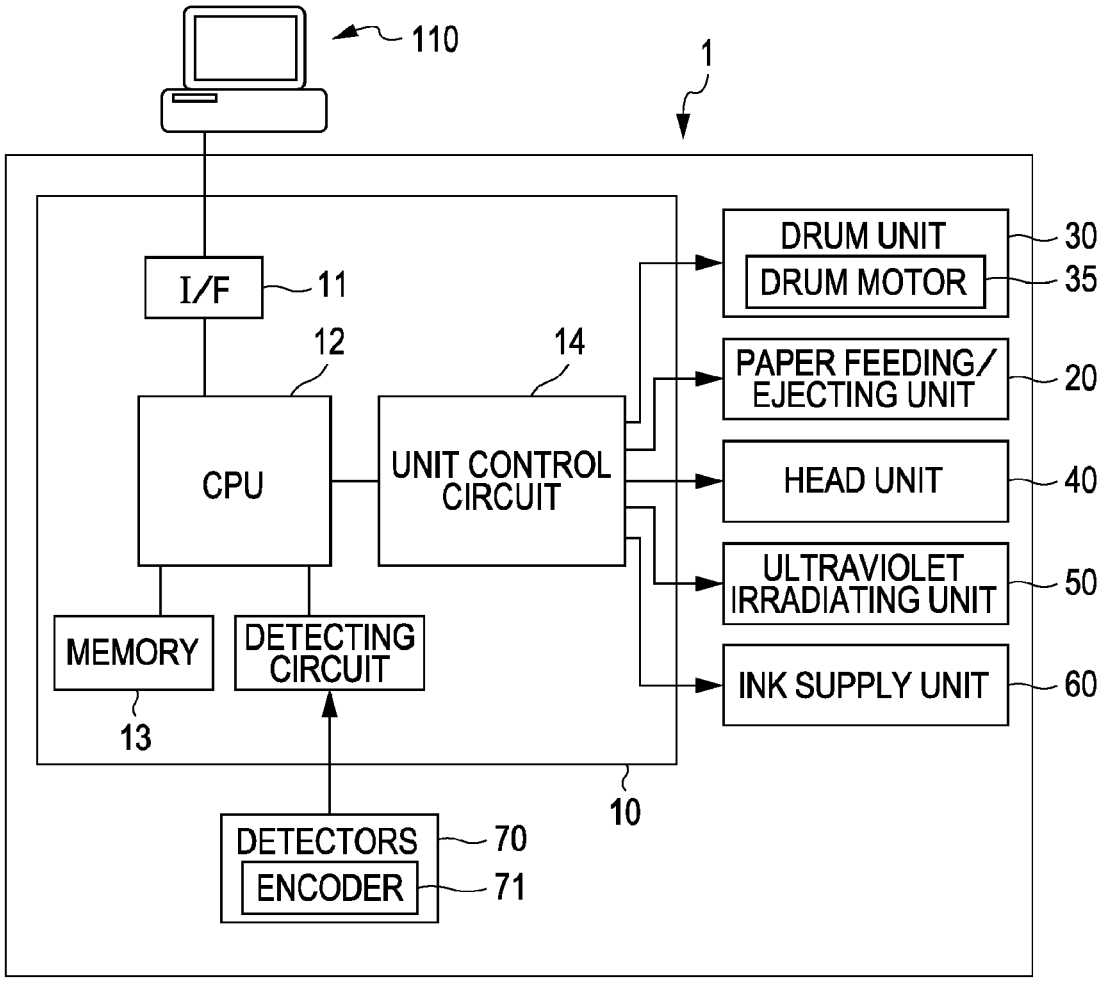
FIG. 1 is a block diagram illustrating the entire configuration of a printer 1.

At least the following details will become apparent from descriptions of this specification and the accompanying drawings.

There is provided a rotary-member control apparatus including the following elements. A rotary member is rotatable while supporting an object on the outer curved surface of the member. A motor is supplied with current based on a current profile representing the magnitude pattern of current to rotate the rotary member. A detecting element detects a rotation state of the rotary member during rotation. A control unit generates a one-rotation current profile, representing the magnitude pattern of current corrected on the basis of the rotation state detected through the detecting element and corresponding to one rotation of the rotary member, and supplies corrected current based on the generated one-rotation current profile to the motor to rotate the rotary member. Such a rotary-member control apparatus can easily suppress rotational variation of the rotary member supporting the object.

In the rotary-member control apparatus, it is preferable that the corrected current based on the one-rotation current profile be current corrected on the basis of a rotation state of the rotary member when a constant current is supplied to the motor. In this case, the one-rotation current profile can be generated by simple control.

It is preferable that the rotary-member control apparatus be a liquid discharge apparatus including a discharging unit that discharges a liquid onto a medium serving as the supported object. Preferably, while the control unit repeatedly supplies the corrected current based on the generated one-rotation current profile to the motor to rotate the rotary member supporting the medium a plurality of times, the control unit allows the discharging unit to discharge the liquid onto the medium in order to print an image. In this case, the image quality can be prevented from being degraded.

In this rotary-member control apparatus, it is preferable that the discharging unit move in the axial direction of the rotary member during each rotation and discharge the liquid onto the medium during rotation of the rotary member to print an image on the one medium, and the control unit repeatedly supply the corrected current based on the generated one-rotation current profile to the motor to rotate the rotary member a plurality of times until printing the image onto the one medium is finished. In this case, the image can be appropriately printed on the one medium.

In the rotary-member control apparatus, preferably, when at least one of the length of the medium in the rotation direction in which the rotary member rotates, the length of the medium in the axial direction of the rotary member, and the type of the medium is changed, the control unit generates the one-rotation current profile before the start of printing, and repeatedly supplies the corrected current based on the generated one-rotation current profile to the motor to print the image. In this case, rotational variation of the rotary member can be effectively suppressed.

In the rotary-member control apparatus, preferably, when the body of the apparatus is turned on, the control unit generates the one-rotation current profile before the start of printing, and repeatedly supplies the corrected current based on the generated one-rotation current profile to the motor to print the image. In this case, rotational variation caused by a change in performance of, for example, the rotary member over time can be suppressed.

There is provided a method of controlling the rotation of a rotary member that is rotatable while supporting an object on the outer curved surface of the member. The method includes generating a one-rotation current profile, which represents the magnitude pattern of current corrected on the basis of a rotation state detected through a detecting element and corresponds to one rotation of the rotary member, and supplying corrected current based on the generated one-rotation current profile to a motor to rotate the rotary member. According to the method, rotational variation of the rotary member supporting the object can be easily suppressed.

Overview of Ink Jet Printer

An ink jet printer (hereinafter, referred to as "printer 1"), serving as a liquid discharge apparatus, will be described as an example of a rotary-member control apparatus, and an exemplary configuration of the printer 1 and an exemplary printing process will be described below. Configuration of Printer 1

Figure 2:
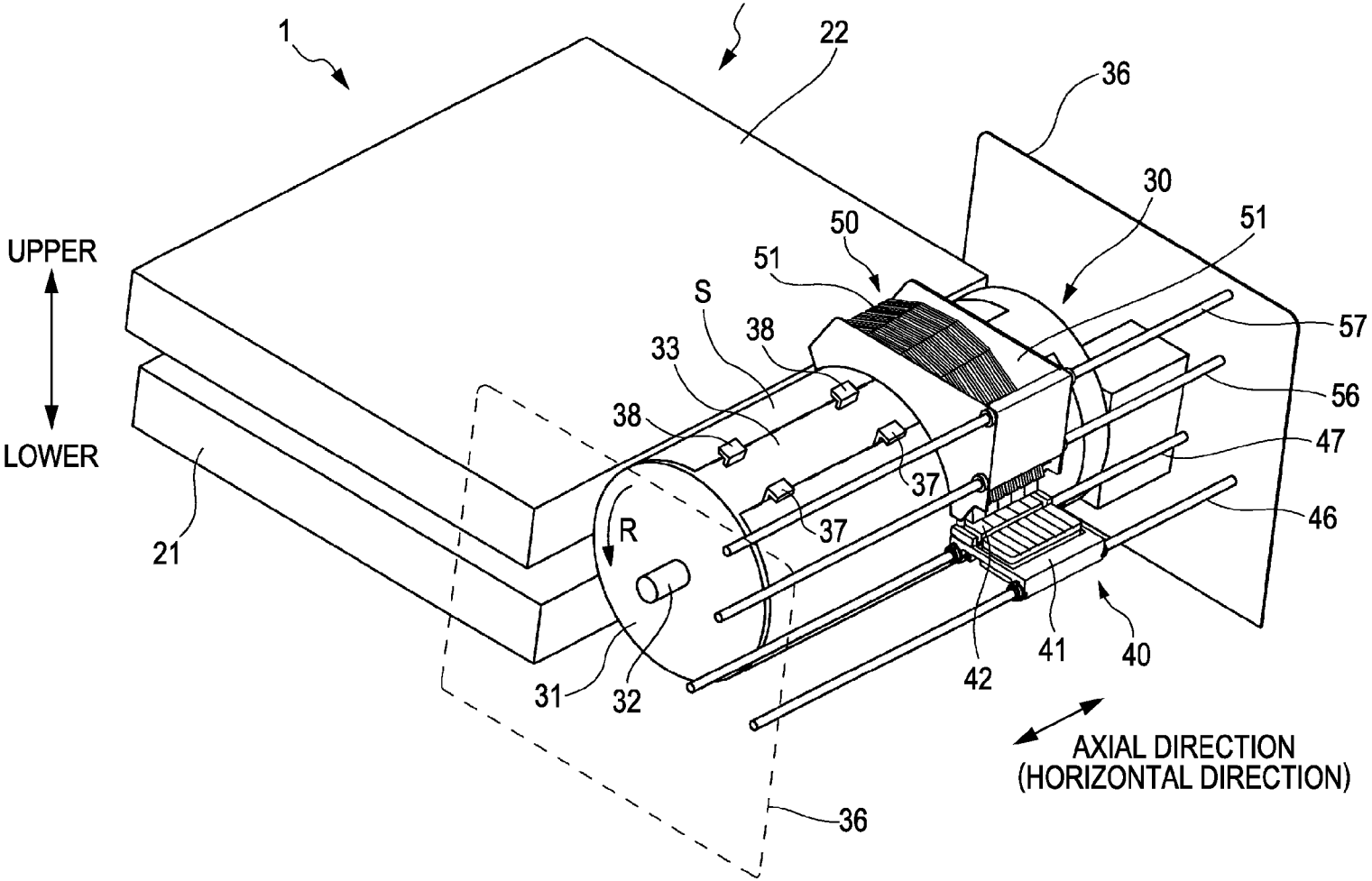
FIG. 2 is a diagram illustrating the configuration of a substantial portion of the printer 1.
Figure 3:
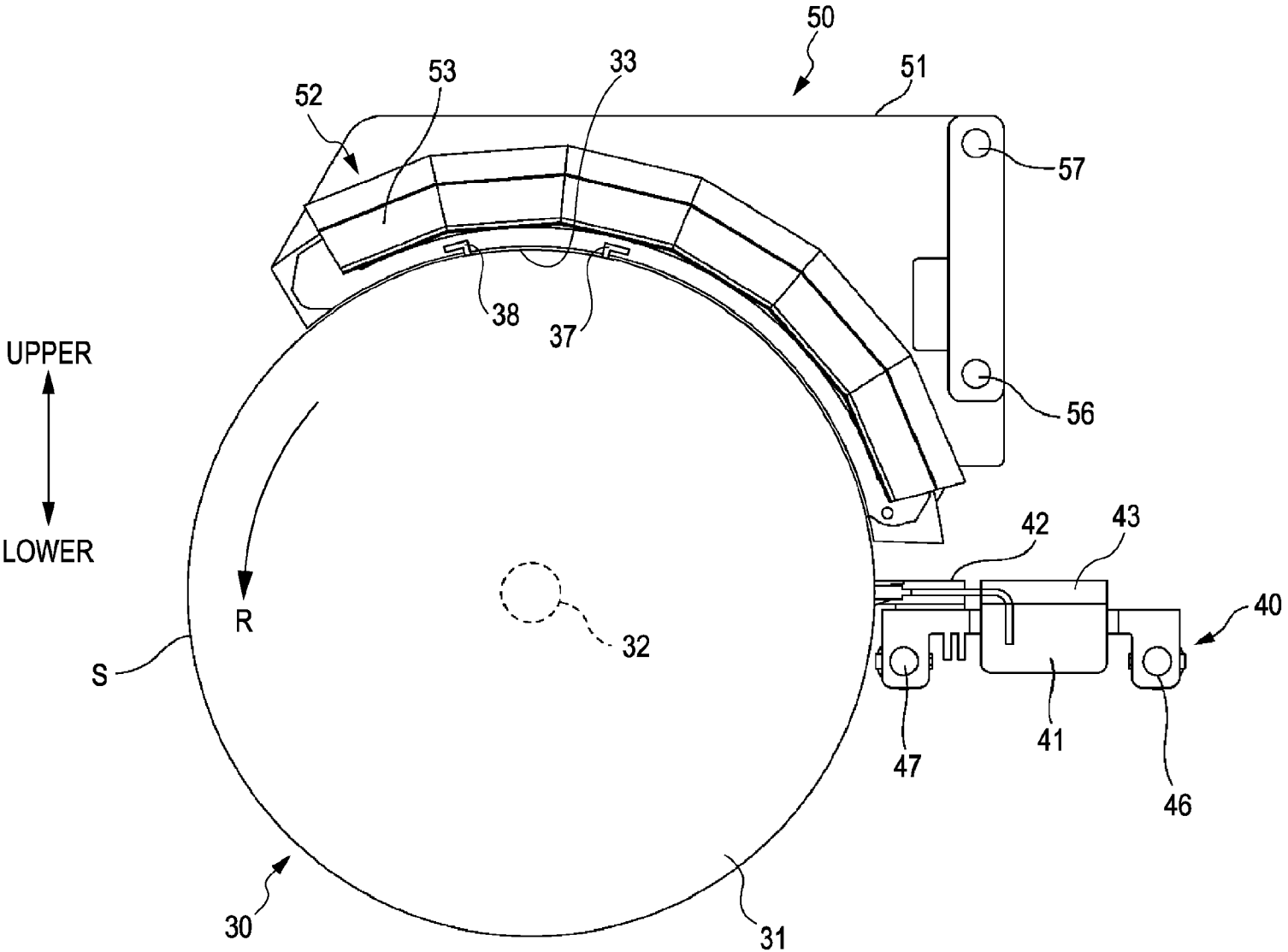
FIG. 3 is a diagram illustrating the cross-sectional configurations of a drum unit 30, a head unit 40, and an ultraviolet irradiating unit 50.
Figure 4A:
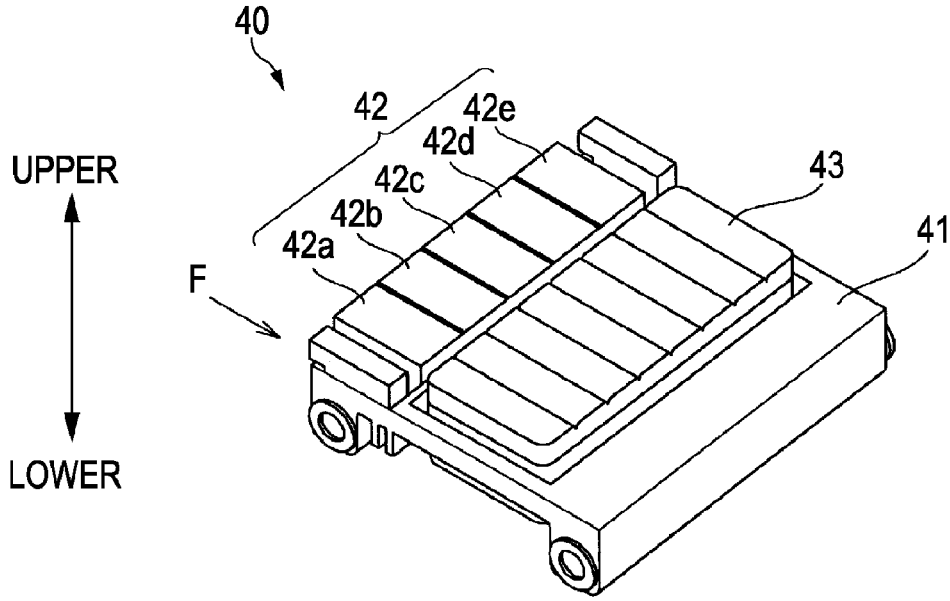
FIG. 4A is a perspective view of the head unit 40.
Figure 4B:
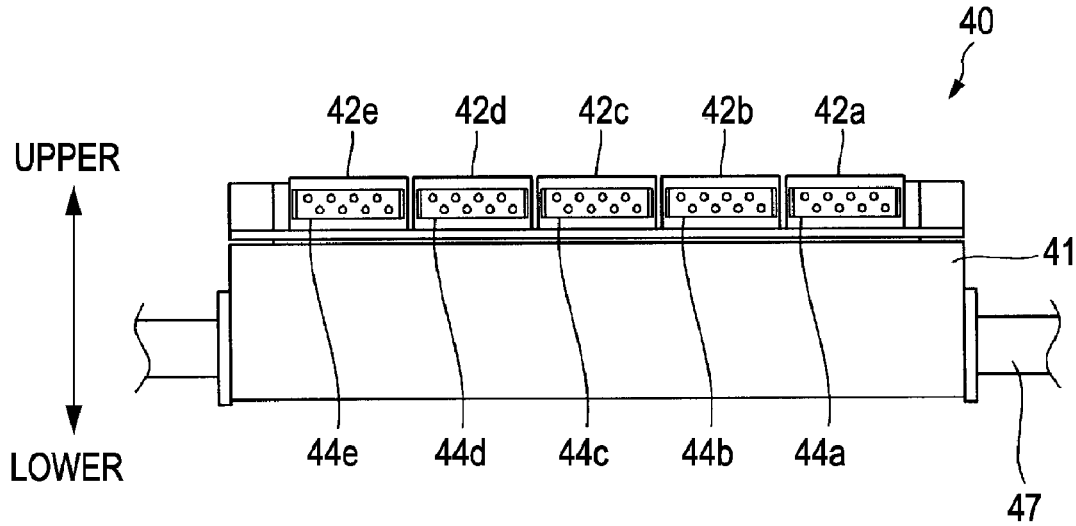
FIG. 4B is a front view of heads 42 as viewed from the direction indicated by the arrow F in FIG. 4A.

FIG. 1 is a block diagram illustrating the entire configuration of the printer 1. FIG. 2 is a diagram illustrating the configuration of a substantial portion of the printer 1. FIG. 3 is a diagram illustrating the cross-sectional configurations of a drum unit 30, a head unit 40, and an ultraviolet irradiating unit 50. FIG. 4A is a perspective view of the head unit 40. FIG. 4B is a front view of heads 42 as viewed from the direction indicated by the arrow F in FIG. 4A.

When receiving print data from a computer 110 as an external apparatus, the printer 1 allows a controller 10 to control the respective units (i.e., a paper feeding/ejecting unit 20, the drum unit 30, the head unit 40, the ultraviolet irradiating unit 50, and an ink supply unit 60), thus forming an image on a sheet S serving as an example of a medium (printing process). In addition, detectors 70 monitor a state in the printer 1. The controller 10 controls the respective units on the basis of the results of detection.

The controller 10 is a control unit for controlling the printer 1. An interface unit 11 is used to transfer data between the computer 110, serving as the external apparatus, and the printer 1. A CPU 12 is an arithmetic processing unit for controlling the whole of the printer 1. A memory 13 is used to provide an area for storage of a program for the CPU 12 and a working area. The CPU 12 controls the respective units through a unit control circuit 14 in accordance with the program stored in the memory 13.

Referring to FIG. 2, the paper feeding/ejecting unit 20 includes a paper feeding section 21 and a paper ejecting section 22. The paper feeding section 21 has a paper feed roller (not shown) transporting the sheet S. The paper feeding section 21 feeds the sheets S, stacked in the paper feeding section 21, one by one to the drum unit 30. The paper ejecting section 22 has a paper ejection roller (not shown) transporting the sheet S. The sheet S which has been subjected to printing while being supported on the drum unit 30 is transported to the paper ejecting section 22.

The drum unit 30 includes a holding drum 31 and a drum motor 35. The holding drum 31 is an example of a rotary member that is rotatable while supporting the sheet S, serving as an object, supported on an outer curved surface 33. The drum motor 35 is an example of a motor rotating the holding drum 31. The holding drum 31 holds the sheet S fed from the paper feeding section 21. A rotation shaft 32 of the holding drum 31 is rotatably supported by a pair of frames 36. The drum motor 35 is supplied with current based on a current profile representing the magnitude pattern of current. The drum motor 35 rotates the holding drum 31. While supporting the sheet S on the outer curved surface 33, the holding drum 31 is rotated in the direction, indicated by the arrow R in FIG. 2, by the drum motor 35.

The head unit 40 is supported by a pair of guide shafts 46 and 47. The head unit 40 has a head carriage 41 that is reciprocatable in the axial direction of the holding drum 31. On the head carriage 41, the heads 42 are arranged. The heads 42 each serve as an example of a discharging unit that discharges an ink as a liquid onto the sheet S. In this embodiment, five heads 42*a* to 42*e* (refer to FIG. 4B) discharging inks of different colors are arranged so as to face the sheet S held on the holding drum 31. The heads 42*a* to 42*e* have nozzle plates 44*a* to 44*e*, respectively. Each nozzle plate includes a plurality of nozzles from which the corresponding ink is discharged. Each nozzle is provided with a pressure chamber (not shown) storing the corresponding ink and a driving element (piezo element) which changes the capacity of the pressure chamber to discharge the ink.

The head carriage 41 is provided with storage chambers 43 storing the respective inks. Each storage chamber 43 supplies a certain amount of ink to the corresponding head 42. In this embodiment, an ultraviolet (UV) curable ink that is cured by ultraviolet irradiation is used as the ink. In this case, the UV curable ink is prepared by adding an adjuvant, such as an antifoaming agent or a polymerization inhibitor, to a mixture of vehicle, a photopolymerization initiator, and a pigment. The vehicle is prepared by mixing a photopolymerization curing oligomer or monomer with a reactive diluent in order to control the viscosity.

The ultraviolet irradiating unit 50 is supported by a pair of guide shafts 56 and 57. The ultraviolet irradiating unit 50 has an irradiating-section carriage 51 that is reciprocatable in the axial direction of the holding drum 31. The irradiating-section carriage 51 is provided with an ultraviolet irradiating section 52 that irradiates the inks, discharged from the heads 52 and deposited on the sheet S, with ultraviolet rays. The ultraviolet irradiating section 52 has a plurality of lamps 53 aligned in the direction in which the holding drum 31 is rotated. The lamps 53 irradiate the inks on the sheet S with ultraviolet rays, thereby curing the inks.

The detectors 70 are used to detect the states of the respective units. The detectors 70 include a drum encoder 71 which serves as an example of a detecting element detecting a rotation state (in this case, the amount of rotation) of the holding drum 31. The drum encoder 71 is a rotary encoder and includes a calibrated scale and a photosensor including a light emitting device and a light sensitive device.

Printing Process

When receiving a print instruction and print data from the computer 110, the controller 10 analyzes descriptions of various commands included in the print data and controls the respective units to perform the following printing process.

The paper feeding section 21 feeds a sheet S to the holding drum 31. The fed sheet S is held by the holding drum 31 such that the sheet S is wound on the outer curved surface 33 of the holding drum 31. The held sheet S rotates together with the holding drum 31. The respective heads 42 discharge the inks onto the rotating sheet S to deposit the inks on the sheet S. The inks deposited on the sheet S are moved in association with the rotation of the holding drum 31 and are irradiated with ultraviolet rays by the ultraviolet irradiating section 52. Thus, the inks on the sheet S are cured, so that an image segment is formed on the sheet S.

During one rotation of the holding drum 31, the image segment is printed on the sheet S in an area of the holding drum 31 along the axial direction thereof. After that, the head carriage 41 moves along the guide shafts 46 and 47 (the irradiating-section carriage 51 similarly moves along the guide shafts 56 and 57). The above-described operation (ink discharge by the heads 42 and ultraviolet irradiation by the ultraviolet irradiating section 52) is performed on an area next to the above-described area in the axial direction.

As described above, the heads 42 move in the axial direction of the holding drum 31 in each rotation of the holding drum 31 and discharge the inks onto the sheet S during rotation of the holding drum 31, so that the whole image is printed on the one sheet S. The sheet S, on which the whole image has been printed in the axial direction of the holding drum 31, is separated from the holding drum 31 and is then transported to the paper ejecting section 22. The printing process is finished.

Rotational Variation Associated with Eccentricity of Holding Drum 31

As described above, the holding drum 31 rotates while holding the sheet S. To hold the sheet S, the holding drum 31 has catching members 37, 38 that catch the sheet S. Incidentally, the holding drum 31 having the catching members 37, 38 is apt to be eccentric. The eccentricity causes rotational variation of the holding drum 31. The cause of the eccentricity and a state of rotational variation will now be described below.

Figure 5A:
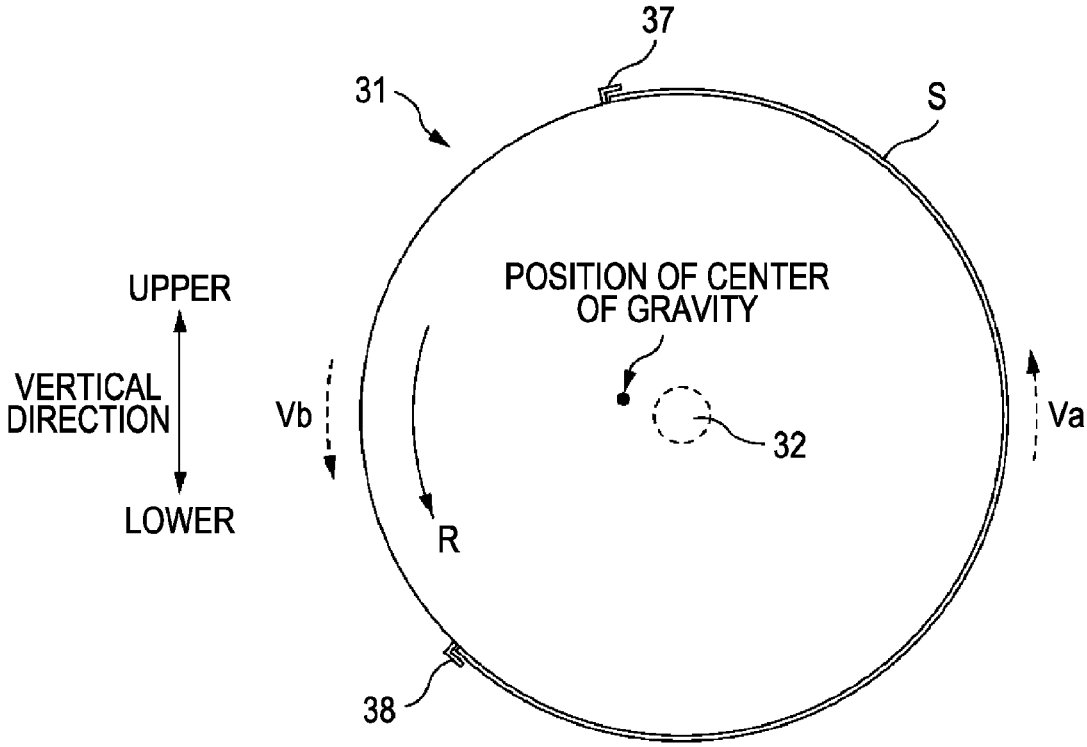
FIGS. 5A and 5B are diagrams illustrating states in each of which a sheet S is held on a holding drum 31 through catching members 37, 38.
Figure 5B:
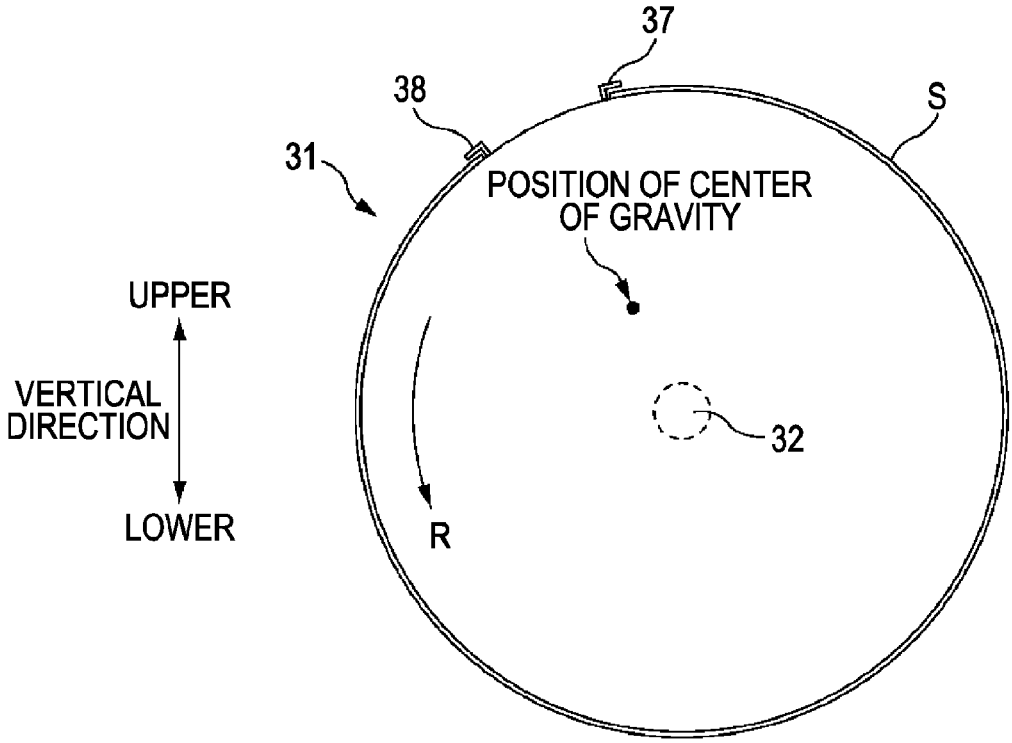

FIGS. 5A and 5B are diagrams each illustrating a state in which a sheet S is held on the holding drum 31 through the catching members 37, 38. In FIG. 5A, the length of the sheet S (the length thereof in the rotation direction of the holding drum 31) is less than the other sheet S in FIG. 5B.

Each sheet S is held on the holding drum 31 such that the leading edge of the sheet S is caught by the catching members 37 and the trailing edge thereof is caught by the catching members 38 and the sheet S is wound around the holding drum 31. In this case, although the catching members 37 are not moved, the catching members 38 are movable in the rotation direction of the holding drum 31 through a mechanism (not shown). The reason is that the catching members 38 each have to be moved up to a position where the member can catch the trailing edge of the sheet S.

As described above, the relative positions of the catching members 37, 38 depend on the lengths of the sheets S. In addition, the catching members 37, 38 are located only in parts of the outer curved surface of the holding drum 31 in the circumferential direction thereof (see FIG. 2). Accordingly, as shown in FIGS. 5A and 5B, the position of the center of gravity of the holding drum 31 is offset from the rotation shaft of the holding drum 31 (namely, the holding drum 31 is eccentric).

The eccentricity of the holding drum 31 is affected by the length and the width of a sheet S (the length of the sheet S along the axial direction of the holding drum 31) and the type of the sheet S (for example, the weight of the sheet S varies depending on the type of the sheet S). In other words, when the widths of the sheets S differ from each other or the types of the sheet S vary, the position of the center of gravity of the holding drum 31 also varies.

When the sheets S vary in length, width, and/or type, there is a high possibility that the degree of eccentricity of the holding drum 31 may vary.

When the holding drum 31 rotates while being eccentric, the rotational speed of the holding drum 31 fluctuates during rotation. In other words, rotational variation occurs. In particular, since the rotation shaft 32 of the holding drum 31 extends in the horizontal direction (see FIG. 2) in the embodiment, the rotational speed is more easily affected by gravity during rotation as compared with a case where the rotation shaft 32 extends in the vertical direction. More specifically, while a specific portion of the holding drum 31 is moving upward in the vertical direction, the gravity becomes a reaction, so that the rotational speed, indicated by Va in FIG. 5A, of the holding drum 31 is reduced. On the other hand, while the specific portion of the holding drum 31 is moving downward in the vertical direction, the holding drum 31 is accelerated by the gravity, so that the rotational speed, indicated by Vb in FIG. 5A, of the holding drum 31 is increased.

The occurrence of the rotational variation of the holding drum 31 causes a landing position of each ink droplet on the sheet S held on the holding drum 31, which is rotating, to be deviated from an ideal position (the deviation is called "dot shift"). Consequently, the quality of an image printed on the sheet S is degraded.

Holding-Drum Rotation Control

To suppress the above-described rotational variation of the holding drum 31, the printer 1 performs drum rotation control, which will be described below, on the holding drum 31.

The major features of the drum rotation control in the embodiment are as follows: The control includes (a) generating a one-rotation current profile that represents the magnitude pattern of current corrected on the basis of a rotation state of the holding drum 31 detected by the drum encoder 71 and corresponds to one rotation of the holding drum 31, and (b) supplying the corrected current based on the generated one-rotation current profile to the drum motor 35 to rotate the holding drum 31. The one-rotation current profile will be described later.

Various operations of the printer 1 during execution of the drum rotation control are primarily realized by the controller 10. In particular, in the embodiment, the CPU 12 processes the program stored in the memory 13 to realize the operations. The program includes codes for the various operations which will be described below.

Figure 6:
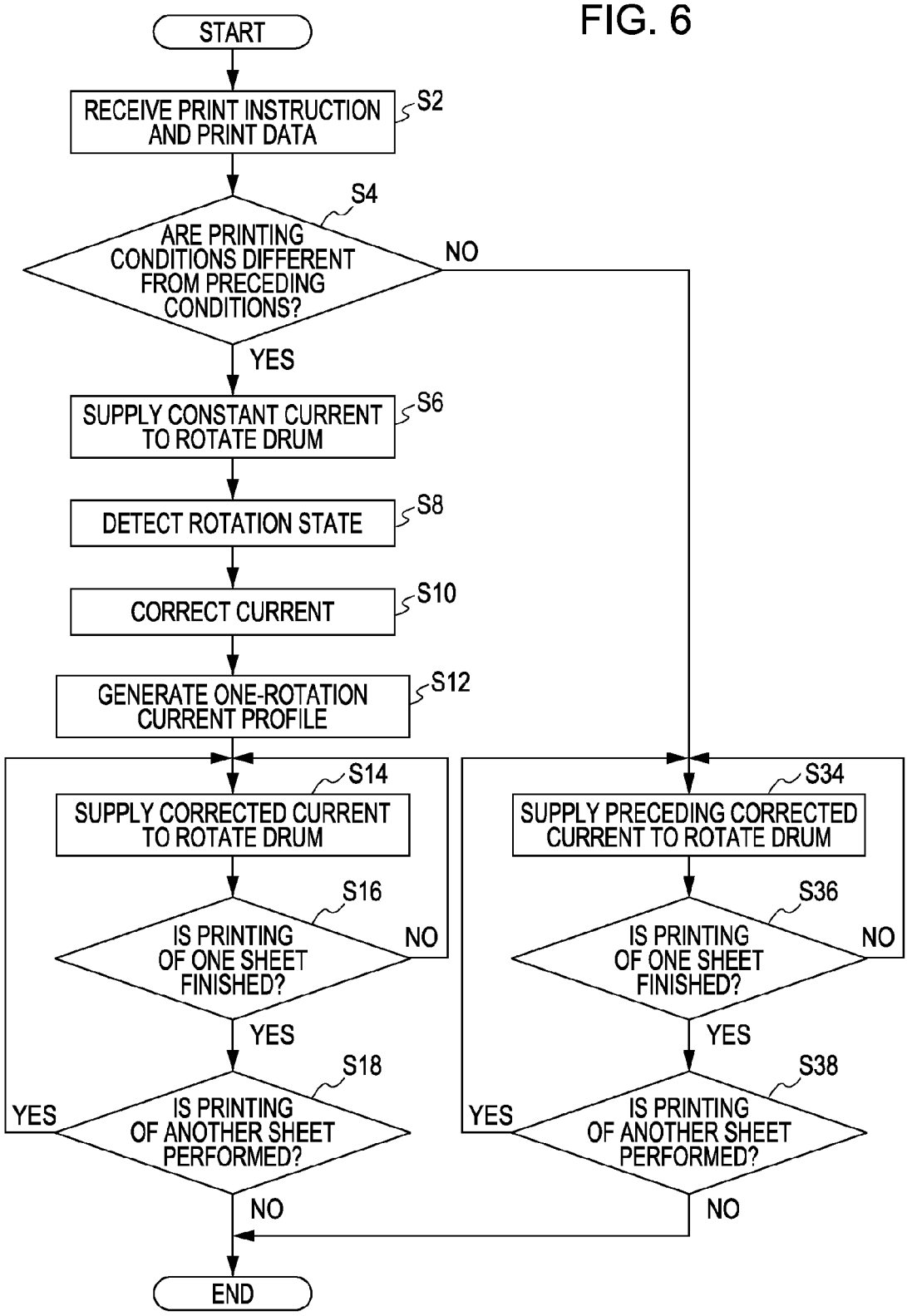
FIG. 6 is a flowchart explaining drum rotation control.

FIG. 6 is a flowchart explaining the drum rotation control. This flowchart starts when the printer 1 receives a print instruction and print data from the computer 110 (step S2). The print data includes information regarding printing conditions. This information relates to the length, width, and type of a sheet S onto which an image is printed.

When the printing conditions differ from the preceding printing conditions (YES in step S4), the controller 10 corrects current to be supplied to the drum motor 35 prior to printing the image. The reason is that when the printing conditions are changed, current supplied on the preceding printing conditions is not necessarily suitable for the present printing conditions. In the embodiment, when at least one of the length, width, and type of the sheet S is changed as a printing condition, current is corrected before the start of printing.

Current is corrected in accordance with the following procedure.

Figure 7A:
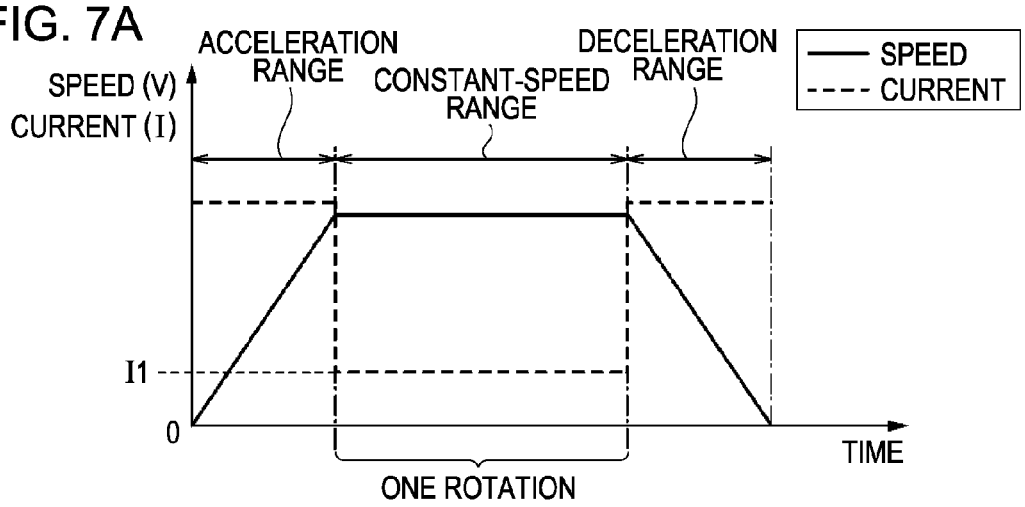
FIG. 7A is a diagram showing the control relationship between a current supplied to a drum motor 35 and a rotational speed of the holding drum 31.
Figure 7B:
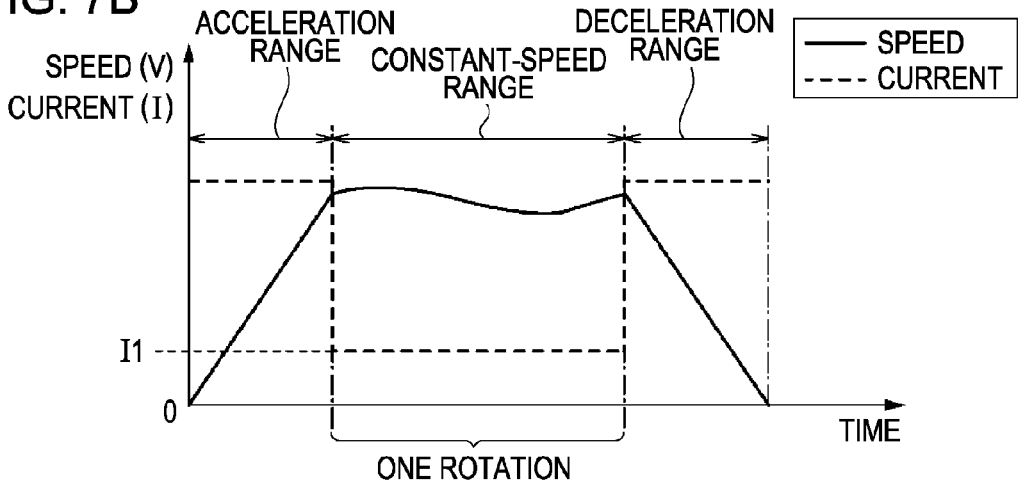
FIG. 7B is a diagram explaining the occurrence of rotational variation due to eccentricity of the holding drum 31.
Figure 7C:
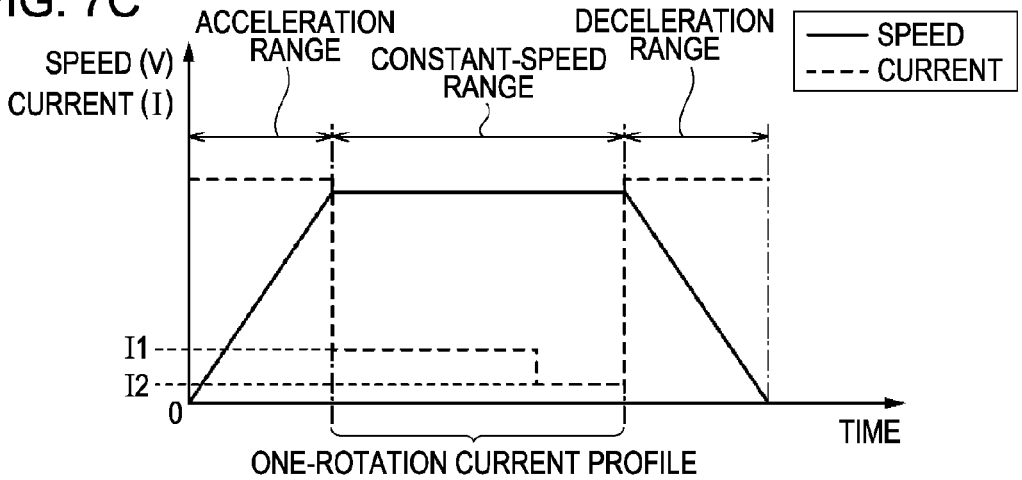
FIG. 7C is a diagram explaining the elimination of rotational variation by current correction.

FIG. 7A is a diagram illustrating the control relationship between a current supplied to the drum motor 35 and a rotational speed of the holding drum 31. FIG. 7B is a diagram explaining the occurrence of rotational variation caused by the eccentricity of the holding drum 31. FIG. 7C is a diagram explaining the elimination of the rotational variation by current correction.

The controller 10 supplies current (indicated by a dashed line in FIG. 7A) based on a predetermined current profile to the drum motor 35 when a sheet S is held on the holding drum 31 (step S6). In this instance, the current profile is a reference profile for current correction. Each current correction uses the same current profile. The drum motor 35 is supplied with current to rotate the holding drum 31. As shown in FIG. 7A, the controller 10 controls the rotation of the holding drum 31 such that the drum is accelerated in an acceleration range, a constant current I1 is supplied to maintain a constant speed in a constant-speed range, the drum is decelerated in a deceleration range, and the drum is stopped. In the embodiment, the holding drum 31 rotates once in the constant-speed range. Certainly, the holding drum 31 may rotate two or more times in the constant-speed range.

The controller 10 detects a rotation state (in this case, the amount of rotation) of the holding drum 31 through the drum encoder 71 while the holding drum 31 rotates once in the constant-speed range (step S8). The controller 10 then obtains a change in rotational speed of the holding drum 31 in the constant-speed range on the basis of the detected amount of rotation.

If the holding drum 31 ideally rotates without being affected by the eccentricity of the holding drum 31, the magnitude of the rotational speed is constant in the constant-speed range as shown in FIG. 7A (namely, any rotational variation does not occur). Actually, however, the rotational speed of the holding drum 31 fluctuates due to the above-described eccentricity in the constant-speed range as shown in FIG. 7B (namely, rotational variation occurs).

Hence, the controller 10 corrects current to be supplied to the drum motor 35 in order to suppress a fluctuation in rotational speed in the constant-speed range (step S10). More specifically, the controller 10 corrects current so that the rotational speed of the holding drum 31 is kept constant in the constant-speed range as shown in FIG. 7C.

Note that the magnitude pattern of current in the constant-speed range is corrected but those in the acceleration and deceleration ranges are not corrected. The reason is as follows. Since image printing is performed during rotation of the holding drum 31 in the constant-speed range, rotational variation only in the constant-speed range has to be suppressed. Accordingly, time required for current correction can be prevented from extending. As a matter of course, current in the acceleration range and that in the deceleration range may be corrected.

As described above, current is corrected so that the rotational speed of the holding drum 31 in the constant-speed range is kept at a fixed value. Thus, rotational variation of the holding drum 31 during image printing can be suppressed.

Referring again to the flowchart of FIG. 6, the drum rotation control will be further described. The controller 10 generates a one-rotation current profile (hereinafter, referred to as "corrected current profile") that represents the magnitude pattern of corrected current and corresponds to one rotation of the holding drum 31 prior to the start of printing (step S12). More specifically, the controller 10 generates the one-rotation current profile for rotating the holding drum 31 once in the constant-speed range as shown in FIG. 7C.

The controller 10 repeatedly supplies the corrected current based on the generated one-rotation current profile to the drum motor 35 to perform image printing. In this case, image printing is performed by a plurality of rotations of the holding drum 31 and movement of the heads 42 (the head carriage 41).

Figure 8A:
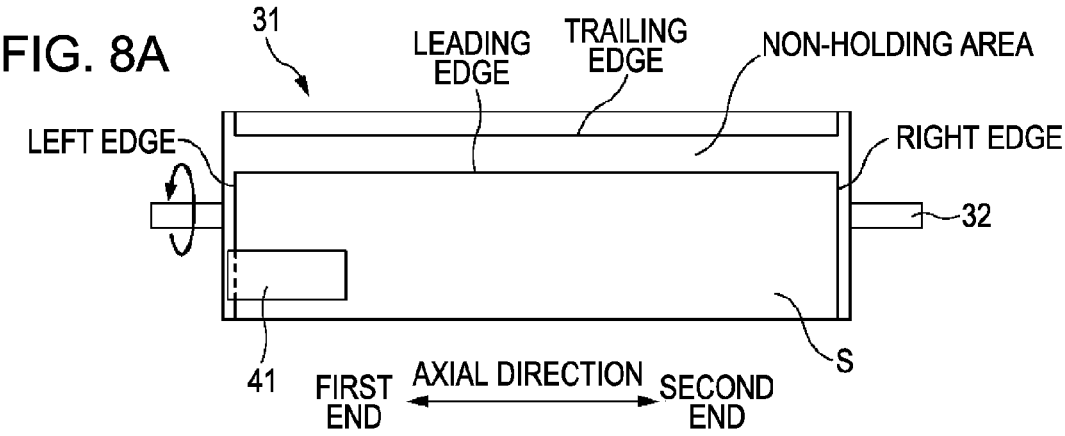
FIGS. 8A to 8C are diagrams illustrating the positional relationship between the holding drum 31 and a head carriage 41 during image printing.
Figure 8B:
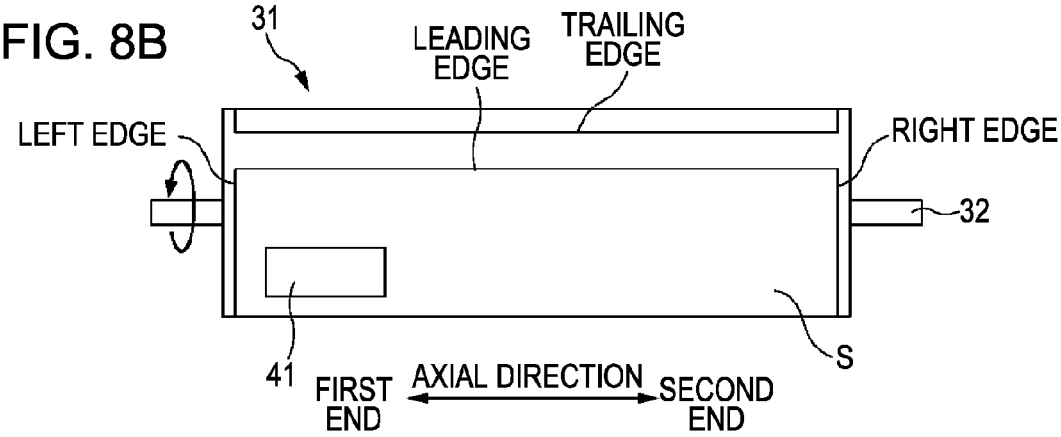
Figure 8C:
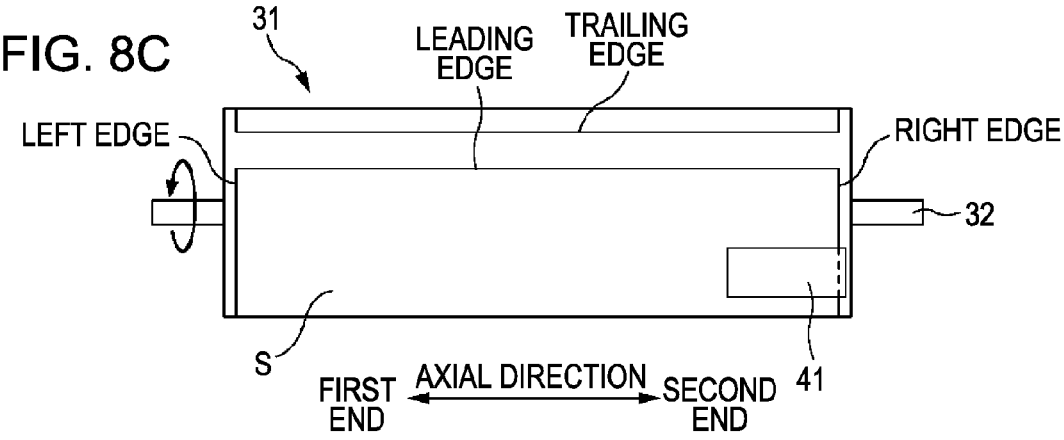
Figure 9:
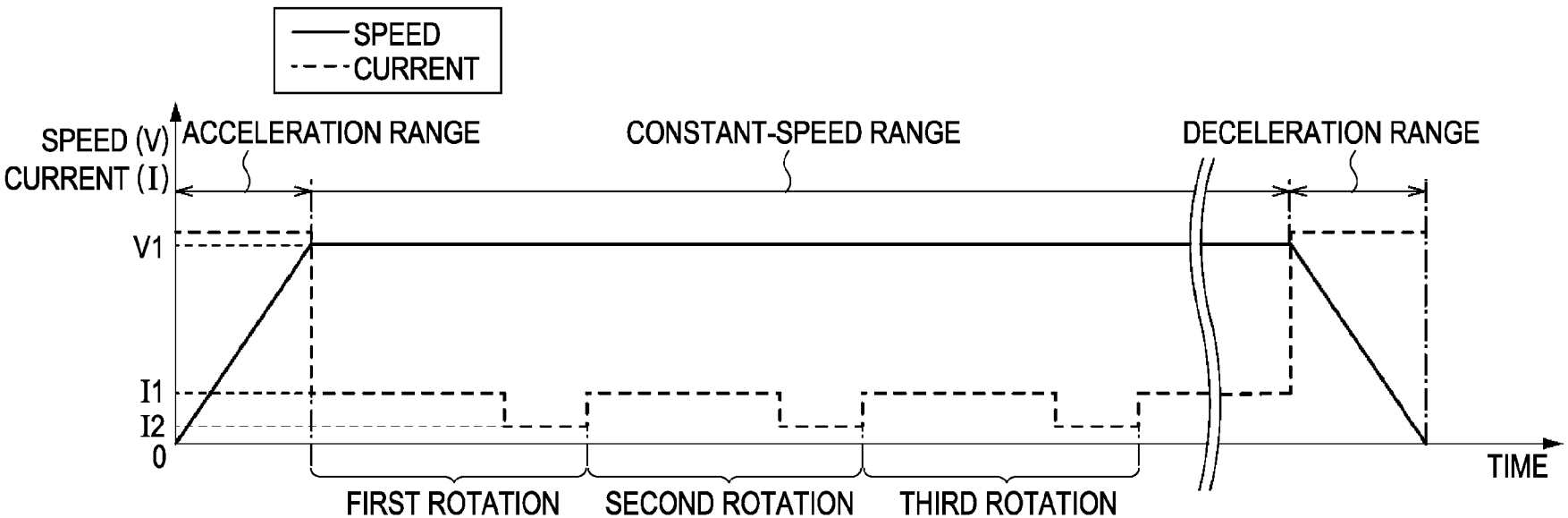
FIG. 9 is a diagram illustrating a current profile during image printing.

FIGS. 8A to 8C illustrate the positional relationship between the holding drum 31 and the head carriage 41 during image printing. FIG. 9 illustrates a current profile during image printing.

The controller 10 allows the holding drum 31 to rotate once at a constant speed while the head carriage 41 is being located on the left of a sheet S (FIG. 8A). The one rotation is performed by supply of corrected current, based on a one-rotation current profile for the first rotation shown in FIG. 9, to the drum motor 35 (step S14). The supply of the corrected current suppresses rotational variation of the holding drum 31 in the first rotation. Since inks are discharged from the heads 42 onto the sheet S during the first rotation of the holding drum 31, the quality of an image segment can be prevented from being degraded due to rotational variation.

When the first rotation of the holding drum 31 is finished (more specifically, when the non-holding area, where the sheet S is not held, of the holding drum 31 faces the head carriage 41), the controller 10 allows the head carriage 41 to move from a first end toward a second end in the axial direction of the holding drum 31 by a predetermined distance (refer to FIG. 8B). The heads 42 do not discharge the inks during movement of the head carriage 41.

The controller 10 again supplies the corrected current based on the one-rotation current profile (which is the same as that for the first rotation) for the second rotation shown in FIG. 9 to the drum motor 35 (NO in step S16, and step S14). Thus, the holding drum 31 performs the second rotation at the constant speed without stopping. In the second rotation, rotational variation is also suppressed. While the holding drum 31 performs the second rotation, the heads 42 discharge the inks onto the sheet S.

In this case, the first rotation and the second rotation of the holding drum 31 are performed on the basis of the same one-rotation current profile. Accordingly, dots formed in the first rotation of the holding drum 31 and those in the second rotation thereof are prevented from shifting. Consequently, the degradation in image quality caused by dot shift can be prevented.

After that, the above-described operation is repeatedly performed until the heads 42 discharge the inks while the head carriage 41 is located on the right of the sheet S (FIG. 8C). As described above, while the controller 10 repeatedly supplies the corrected current based on the one-rotation current profile to the drum motor 35 to continuously rotate the holding drum 31 a plurality of times, the controller 10 allows the heads 42 to discharge the inks onto the sheet S, thereby printing an image (YES in step S16).

While the holding drum 31 rotates a plurality of times, the respective rotations have the same rotational speed. Thus, landing positions of ink droplets can be prevented from varying from rotation of the holding drum 31 to rotation (namely, dot shift in each rotation can be prevented).

When the present printing conditions are the same as the preceding printing conditions (NO in step S4), the controller 10 supplies current based on the one-rotation current profile used on the preceding printing conditions (this one-rotation current profile is a corrected profile) to the drum motor 35 to rotate the holding drum 31 (step S34). The controller 10 repeatedly supplies the current based on the current profile to the drum motor 35 to rotate the holding drum 31 a plurality of times until printing onto one sheet S is finished (YES in step S36).

As described above, in the case where the printing conditions are not changed, when current based on the preceding current profile is supplied, rotational variation of the holding drum 31 can be suppressed. In addition, it is unnecessary to correct current prior to the start of printing. Accordingly, printing can be immediately achieved.

When printing is continuously performed onto the second and subsequent sheets S after printing on the first sheet S (YES in step S18, YES in step S38), the controller 10 repeatedly supplies the corrected current based on the one-rotation current profile shown in FIG. 9 to print images. Thus, the images are appropriately printed on the same printing conditions.

Modifications

In the above-described embodiment, when at least one of the length, width, and type of a sheet S is changed as a printing condition, current to be supplied to the drum motor 35 is corrected (namely, a one-rotation current profile is generated). The embodiment is not limited to this case. For example, when the body of the printer is turned on, current may be corrected.

Assuming that when the body of the printer is turned on, a one-rotation current profile is generated and corrected current based on the generated one-rotation current profile is repeatedly supplied to the drum motor 35 to print an image, advantages in this case will be described below.

In some cases, the performance of the holding drum 31 changes over time. For example, the holding drum 31 is supported by bearings (not shown) so as to be rotatable. The bearings wear over time, so that the rotational accuracy of the holding drum 31 varies. In some cases, therefore, the degree of rotational variation also fluctuates over time.

In the case where the body of the printer is turned on, considerable time may conceivably have lapsed after the preceding use of the printer 1. Accordingly, when the preceding corrected current is supplied to the drum motor 35 after turn-on of the printer body, there is a possibility that rotational variation of the holding drum 31 cannot be appropriately suppressed because the fluctuation in rotational variation over time is not taken into consideration. On the other hand, when the body of the printer is turned on, the holding drum 31 is allowed to rotate on the basis of a newly generated one-rotation current profile, so that the rotational variation caused by the change in performance of the holding drum 31 over time can be suppressed.

Figure 10:
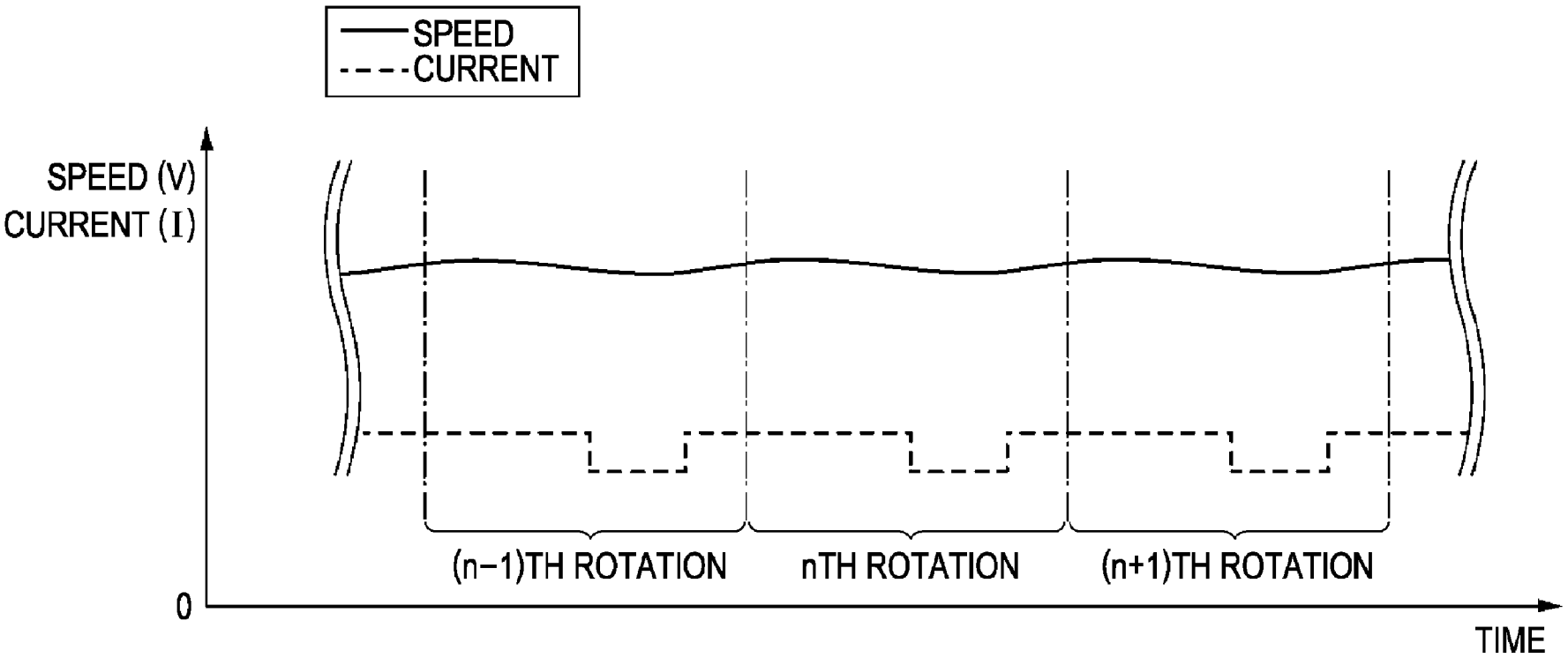
FIG. 10 is a diagram explaining a modification.

In the foregoing embodiment, the rotational speed of the holding drum 31 during continuous rotation has a constant magnitude V1 as shown in FIG. 9. The embodiment is not limited to the case. For example, the rotational speed of the holding drum 31 may slightly fluctuate as shown in FIG. 10 (however, a fluctuation in rotational speed shown in FIG. 10 is smaller than that in FIG. 7B). In other words, the rotational speed of the holding drum 31 fluctuates to a lesser extent such that the fluctuation remains inconspicuous as rotational variation. FIG. 10 is a diagram explaining a modification of the foregoing embodiment.

The modification of FIG. 10 will now be described. According to the modification, corrected current based on the same one-rotation current profile is repeatedly supplied, so that the holding drum 31 continuously rotates a plurality of times (to print an image). Since the same current profile is used, the rotational speed of a specific portion of the holding drum 31 is kept constant in each rotation. Thus, dot shift caused by a plurality of rotations of the holding drum 31 can be prevented.

Effectiveness of Printer 1

As described above, the printer 1 (serving as an example of the rotary-member control apparatus) according to the embodiment includes (A) the holding drum 31 (serving as an example of the rotary member) which is rotatable while supporting a sheet S (serving as an example of an object supported) on its outer curved surface, (B) the drum motor 35 (serving as an example of the motor) which is supplied with current based on a current profile representing the magnitude pattern of current to rotate the drum motor 35, (C) the drum encoder 71 (serving as an example of the detecting element) which detects a rotation state (e.g., the amount of rotation) of the holding drum 31 which is rotating, and (D) the controller 10 (serving as an example of the control unit) which generates a one-rotation current profile, representing the magnitude pattern of current corrected on the basis of the rotation state detected by the drum encoder 71 and corresponding to one rotation of the holding drum 31, and supplies corrected current based on the generated one-rotation current profile to the drum motor 35 to rotate the holding drum 31. Thus, rotational variation of the holding drum 31 supporting the sheet S can be easily suppressed.

In other words, since current is corrected on the basis of the amount of rotation (specifically, rotational speed obtained from the amount of rotation) of the holding drum 31 detected through the drum encoder 71, an appropriate current profile (one-rotation current profile) reflecting the eccentricity of the holding drum 31 (caused by the catching members 37, 38 and the sheet S) is generated. The corrected current based on the generated one-rotation current profile is supplied to the drum motor 35, thus suppressing rotational variation of the holding drum 31. It is unnecessary to correct (e.g., feedback-control) the rotational speed of the holding drum 31 during rotation. Therefore, the rotational variation of the holding drum 31 can be easily suppressed by simple control.

The corrected current based on the one-rotation current profile is current corrected on the basis of a rotation state of the holding drum 31 when a constant current (the current I1 in FIG. 7A) is supplied to the drum motor 35.

In this case, since sampling is performed while the same constant current I1 is supplied in each current correction, the one-rotation current profile can be generated by simple control.

In addition, the rotary-member control apparatus corresponds to the ink jet printer (serving as an example of the liquid discharge apparatus) including the heads 42 (each serving as an example of the discharging unit) discharging the inks (each serving as an example of the liquid) onto the sheet S (serving as an example of the medium) as a supported object. The controller 10 repeatedly supplies the corrected current based on the generated one-rotation current profile to the drum motor 35 to rotate the holding drum 31 supporting the sheet S a plurality of times and allows the heads 42 to discharge the inks onto the sheet S during rotation of the holding drum 31, thus printing an image.

In this case, while the holding drum 31 holding the sheet S rotates a plurality of times, landing positions of ink droplets can be prevented from shifting due to rotational variation (the shift of the landing positions leads to density variation). Consequently, the quality of the image printed on the sheet S can be prevented from being degraded.

Furthermore, the heads 42 move in the axial direction of the holding drum 31 in each rotation of the holding drum 31 and discharge the inks onto the sheet S during rotation of the holding drum 31, thereby printing the image on the one sheet S (refer to FIGS. 8A to 8C). The controller 10 repeatedly supplies the corrected current based on the generated one-rotation current profile to the drum motor 35 to rotate the holding drum 31 a plurality of times until printing the image onto the one sheet S is finished.

In this case, the corrected current is repeatedly supplied until image printing onto the one sheet S is finished, so that rotational variation of the holding drum 31 is suppressed until the image printing is finished. Advantageously, the image can be appropriately printed on the sheet S.

In addition, when at least one of the length of a sheet S in the rotation direction of the holding drum 31 (namely, the length of the sheet S), the length of the sheet S in the axial direction of the holding drum 31 (namely, the width of the sheet S), and the type of the sheet S (when the type of the sheet S changes, for example, the weight thereof changes) is changed as a printing condition, the controller 10 generates a one-rotation current profile prior to the start of printing (see FIG. 6). The controller 10 repeatedly supplies corrected current based on the generated one-rotation current profile to the drum motor 35 to print an image. In this case, rotational variation of the holding drum 31 can be effectively suppressed as will be described below.

When the length or width of the sheet S changes, a support state of the sheet S changes (specifically, the positions of the catching members 38 catching the sheet S relative to the holding drum 31 are changed). Consequently, since the position of the center of gravity of the holding drum 31 also changes, there is a high possibility that the degree of eccentricity varies. Accordingly, in the case where, for example, the length of the sheet S changes, when the preceding corrected current is supplied, rotational variation of the holding drum 31 cannot be appropriately suppressed. On the other hand, in the case where the length of the sheet S changes, the holding drum 31 is rotated on the basis of a newly generated signal-rotation current profile, so that rotational variation of the holding drum 31 can be effectively suppressed.

In addition, when the body of the printer (serving as an example of the body of the rotary-member control apparatus) is turned on, the controller 10 generates a one-rotation current profile before the start of printing and repeatedly supplies corrected current based on the generated one-rotation current profile to the drum motor 35 to print an image. In this case, as described above, rotational variation caused by a change in performance of, for example, the holding drum 31 over time can be suppressed.

Other Embodiments

The printer has been described in the foregoing embodiment. The foregoing embodiment is intended for easy understanding of the invention and is not intended for limited interpretation of the invention. It should be understood that many modifications and variations of the invention may be made without departing from the spirit and scope of the invention and the invention also includes equivalents thereof. In particular, the invention includes the following embodiments.

In the foregoing embodiment, the printer 1, serving as a liquid discharge apparatus, has been described as an example of the rotary-member control apparatus. The invention may be applied to an apparatus other than the liquid discharge apparatus. For example, the rotary-member control apparatus may be a laser printer having a rotary member supporting a sheet S.

In addition, although the ink jet printer has been described as the liquid discharge apparatus in the foregoing embodiment, the liquid discharge apparatus is not limited to the ink jet printer. The same technique as that described in the embodiment may be applied to various liquid discharge apparatuses using an ink jet technique, e.g., a color filter manufacturing apparatus, a dyeing apparatus, a micromachining apparatus, a semiconductor manufacturing apparatus, a surface treatment apparatus, a three-dimensional molding apparatus, a liquid vaporizing apparatus, an organic EL manufacturing apparatus (particularly, polymer EL manufacturing apparatus), a display manufacturing apparatus, a film deposition apparatus, and a DNA chip manufacturing apparatus.

Although the rotary encoder has been described as an example of the detecting element in the foregoing embodiment, the detecting element may have any structure so long as the element can detect a rotation state (e.g., the amount of rotation) of the holding drum 31.

Although the method of discharging ink using a piezo element has been described in the foregoing embodiment, the embodiment is not limited to this case. The invention may be applied to, for example, a thermal printer. Although the ink is of the UV curable type in the foregoing embodiment, the ink is not limited to this type.

What is claimed is:

1. A holding drum control apparatus comprising:

a holding drum that is rotatable while supporting an object on the outer curved surface of the holding drum;

a motor that is supplied with current based on a current profile representing the magnitude pattern of current to rotate the holding drum;

a detecting element that detects a rotation state of the holding drum during rotation; and a control unit that is configured to generate a one-rotation current profile, representing the magnitude pattern of current corrected on the basis of the rotation state detected through the detecting element and corresponding to one rotation of the holding drum, and configured to supply corrected current based on the generated one-rotation current profile to the motor to rotate the holding drum, wherein the holding drum control apparatus is a liquid discharge apparatus including a discharging unit that discharges a liquid onto a medium serving as the supported object while the holding drum rotates according to the one-rotation current profile, while the control unit repeatedly supplies the corrected current based on the generated one-rotation current profile to the motor to rotate the holding drum supporting the medium a plurality of times, the control unit allows the discharging unit to discharge the liquid onto the medium in order to print an image, and when at least one of the length of the medium in the rotation direction in which the holding drum rotates, a length of the medium in the axial direction of the holding drum, and a type of the medium is changed, the control unit is configured to generate the one-rotation current profile before the start of printing, and configured to repeatedly supply the corrected current based on the generated one-rotation current profile to the motor to print the image while rotating the holding drum according to the generated one-rotation current profile.

2. The apparatus according to claim 1, wherein when the body of the apparatus is turned on, the control unit generates the one-rotation current profile before the start of printing, and repeatedly supplies the corrected current based on the generated one-rotation current profile to the motor to print the image.

* * * * *